United States Patent [19]

Hölemann

[11] 4,173,499

[45] Nov. 6, 1979

[54] METHOD OF OPERATING A CUTTING BURNER

[75] Inventor: Paul Hölemann, Dortmund-Berghofen, Fed. Rep. of Germany

[73] Assignee: Linde Aktiengesellschaft, Wiesbaden, Fed. Rep. of Germany

[21] Appl. No.: 816,690

[22] Filed: Jul. 18, 1977

[30] Foreign Application Priority Data

Jul. 27, 1976 [DE] Fed. Rep. of Germany ..... 2633719

[51] Int. Cl.[2] ..... B23K 7/00; B23K 7/08

[52] U.S. Cl. ..... 148/9 R; 239/422; 266/48

[58] Field of Search ..... 148/9, 9.5; 266/48; 239/422

[56] References Cited

U.S. PATENT DOCUMENTS

| | | | |
|---|---|---|---|
| 3,389,861 | 6/1968 | Nakanishi et al. | 148/9 |
| 3,563,812 | 2/1971 | Nakanishi et al. | 148/9 |

*Primary Examiner*—W. Stallard

*Attorney, Agent, or Firm*—Karl F. Ross

[57] ABSTRACT

A method of operating a metal-cutting burner in which the cutting oxygen is supplied through a central passage to a cutting nozzle and is enveloped in an oxygen curtain which is controlled so that the flow rate of oxygen to the curtain corresponds to 5 to 25% of the oxygen supply rate to the cutting-jet passage.

6 Claims, 4 Drawing Figures

METHOD OF OPERATING A CUTTING BURNER

FIELD OF THE INVENTION

The present invention relates to a method of operating a cutting nozzle or torch and to a cutting device which can be operated by this method. More particularly, the invention relates to improvements in the operation of a cutting torch of the type in which oxygen of high purity is directed at the cutting locations through a central passage of the nozzle of a cutting torch and the curring oxygen is surrounded by a curtain of air-excluding gas, usually oxygen.

BACKGROUND OF THE INVENTION

In the cutting of metals, e.g. steel, it is a common practice to make use of an autogenous process in which the metal, raised to an appropriate temperature, reacts autogenously with oxygen supplied by the torch and is thus burnt away to form a kerf or cut along the line described by the torch.

In its simplest form, a device for this purpose may consist of a nozzle directing a jet of oxygen against a workpiece which has been heated to the necessary temperature.

In practical applications, such torches have been modified to provide the means for heating the workpiece at the location to be subjected to the oxygen jet and to shield the oxygen jet from detrimental influences, e.g. the entrainment of air which has the effect of diluting the cutting oxygen and, by reducing its purity, decreasing the cutting efficiency and/or precluding continued cutting operations and/or causing irregularities in the curve or cut which is produced.

It has been proposed, therefore, as described for example in Swiss Pat. No. 442 939 to provide a torch whose nozzle is formed with a central passage through which the jet of cutting oxygen is directed at the workpiece, at least one passage surrounding this central passage for discharging around the cutting jet a curtain of oxygen serving to exclude air from the cutting jet.

In the system of this Swiss patent, the workpiece is heated by a preheating flame trained upon the workpiece, the preheating flame being directed at an angle to the cutting gas stream or concentrically surrounding same.

The use of an oxygen-containing curtain surrounding the high-purity cutting oxygen stream has been found to markedly improve the cutting efficiency of autogenous cutting burners or torches since the central cutting jet is maintained free from impurities arising from the surrounding preheating gas or from the air in the region of the cutting operation. The high oxygen content or purity of the cutting jet is thus ensured.

Apart from the cutting efficiency, however, there are several parameters of the operation of a cutting torch which must be taken into consideration for satisfactory cutting for a given sheet thickness and workpiece composition.

For example, it is important to maintain the highest possible cutting efficiency and cutting rate while maintaining the maximum cutting precision, i.e. tracking of the kerf along a predetermined path. The cut should be as regular or even as possible and the chamfering depth should be minimized as should the melting of the surface of the workpiece adjacent the kerf, i.e. at the upper edge of the kerf.

By comparison with cutting operations without any oxygen curtain, the oxygen-curtained torch significantly reduces, for otherwise identical conditions, the unevenness of the cut, chamfering of the workpiece and the cleanness of the cut vis-á-vis damage to the workpiece surfaces. However, precision is not as advantageously affected since a narrow kerf along a predetermined path cannot be completely ensured. The problem is most noticeable when the torch is used to cut along curved lines.

To reduce chamfering and increase the precision of the cut it has been proposed to increase the pressure of the oxygen jet. In practice however, this has been found to invariably give rise to a significant increase in the unevenness of the cut, either by the formation of bulging flanks along the cut or, even more commonly, strongly divergent flanks. With an increase in the oxygen pressure at the inlet to the cutting nozzle, there is thus a singificant increase in the width of the cut below the groove formed at the top and the upper surface of the workpiece. The widened kerf is naturally disadvantageous when the cutting operation is to produce products of predetermined shape and size.

OBJECTS OF THE INVENTION

It is the principal object of the present invention to provide an improved method of operating a cutting burner of the type which uses a cutting jet and an oxygen curtain such that, without any significant cost increase, it is possible to obtain both a high cutting rate and optimum cutting finish.

Another object of this invention is to provide an improved nozzle structure for an autogenous cutting torch of the purpose described.

SUMMARY OF THE INVENTION

These objects are attained, in accordance with the present invention, by limiting the flow rate of oxygen through the passage means forming the oxygen curtain to 5 to 25% of the flow rate of the cutting oxygen through the central passage. Most surprisingly, this relatively simple expedient has been found to maintain the high cutting efficiency of the torch but nevertheless reduces any tendency toward unevenness, diminishes damage to the edges of the workpiece adjacent the cut, and eliminates the widely divergent or bulging flanks of the kerf which have hitherto been considered as necessary evils of such autogenous cutting processes.

The invention is based upon my discovery that, when the oxygen is supplied to the oxygen-curtain passage means in an amount which constitutes only a relatively small fraction of the rate of oxygen feed to the jet, an unusually high quality cut can be obtained even with high cutting rates.

For reasons which are not fully understood and are indeed surprising in view of the approach taken in the art heretofore, it appears that the melting of the upper surface of the workpiece adjacent the cut, the formation of deep grooves or chamfers and like disadvantages are either completely eliminated or significantly reduced while the precision of the cut is maintained or increased at high cutting velocities. In fact, the method of the present invention permits reduction of the forepressure (pressure ahead of the nozzle) of the cutting oxygen, which can be reduced to an optimum value for precision without losing some of the advantages gained by earlier techniques operating under much higher pressures. The width of the kerf can be held within tolerable limits and unevenness is eliminated as a problem.

It has been found to be especially advantageous to supply oxygen at a rate which is 5–15% of the oxygen supply rate to the cutting-gas passage.

According to a feature of the invention, the nozzle has a central passage for the cutting oxygen and the passage means for the oxygen curtain consists of at least one passage disposed outwardly of the central cutting-gas passage. The nozzle can be provided with at least one heating gas passage disposed outwardly of the oxygen-curtain passage means, all of the passages opening at the nozzle end.

The term "outwardly" is here used to indicate a radial spacing of the passages forming the oxygen curtain and delivering the heating gas from the central cutting jet passage. The oxygen-curtain passage means can open at an annulus surrounding the outlet of the cutting jet passage which should be spaced by a distance as small as possible from the latter while the heating gas passage should also be as close as possible to the oxygen-curtain passage means. Best results have been obtained when the wall thickness between the oxygen-curtain passage means and the cutting oxygen passage at the outlet of the nozzle is not more than 0.5 mm. Similarly, the wall thickness between the oxygen-curtain passage means and the heating passage should not be more than 0.5 mm. An arrangement of this type has been found to concentrate the preheating flame in the region of the autogenous cutting action and thereby increases the heating rate and reduces the preheating time to permit high cutting speeds.

According to another feature of the invention, the width (radial) of the annular outlet of the oxygen-curtain passage means is not in excess of 0.3 mm. With this dimension, the oxygen curtain has a sufficient discharge velocity to sheath the cutting-oxygen jet over its entire length and thereby shield the cutting oxygen jet against contamination by the surrounding preheating gas. The curtain is effective also to protect the cutting operation from splattering of slag or dross, thereby preventing accumulations of such materials upon the torch and nozzle end.

The delivery of the oxygen to the annular oxygen-curtain passage can be effected separately from the supply of oxygen to the cutting jet, thereby permitting the oxygen pressures to the two passages to be established at will. However, it is possible to subdivide the supplied oxygen within the nozzle and to permit, by appropriate choice of the passage cross sections, only the above stated quantity of oxygen to be delivered to the oxygen-curtain passage means. The pressure control valve of the cutting oxygen then determines the respective flow rates.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
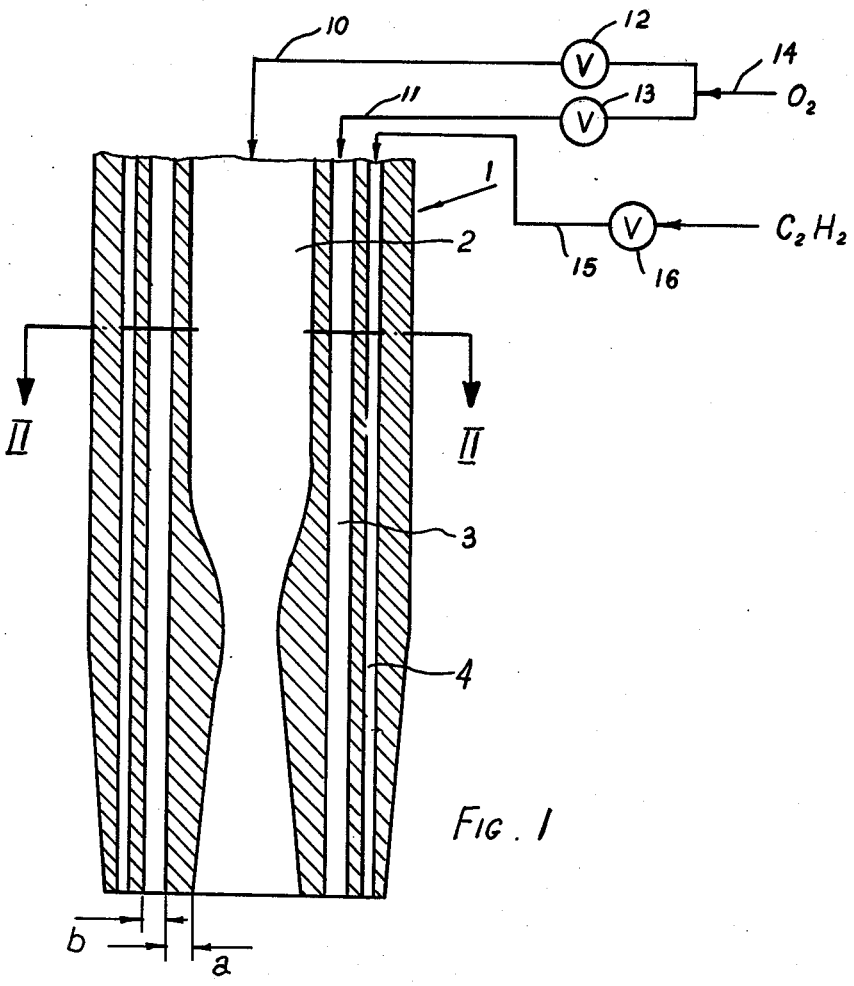
FIG. 1 is a diagrammatic axial cross-sectional view of a nozzle for a burner or torch adapted to be operated by the method of the present invention.
Figure 2:
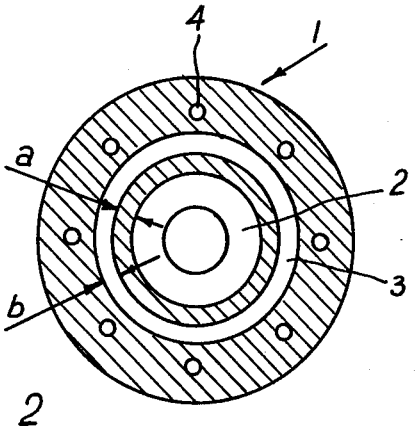
FIG. 2 is a cross-sectional view taken along the line II—II of FIG. 1.

FIGS. 1 and 2 show a cylindrical nozzle for a cutting torch, according to the invention, without the usual supporting elements which can include threaded rings attaching the nozzle to the body of the torch.

The central passage for delivering the cutting oxygen to the discharge end of the nozzle (lower end) can be a cylindrical bore or, as has been shown in FIG. 1, a LAVAL nozzle of the convergent-divergent type. In any event it is preferred to provide the discharge end of this passage with a conically divergent passage section. The specific dimensions and shape of the passage 2 depends upon the throughput of the cutting oxygen and hence upon the nature and dimensions of the workpiece to be cut. When quality of the cut is more important than cutting speed, it suffices to provide the cutting-gas passage 2 as a simple cylindrical bore whose diameter will be selected in accordance with the thickness of the plate to be cut. When higher cutting speeds are desired with the maximum possible cutting quality, I may make use of the LAVAL nozzle as shown or a cylindrical bore having a conical discharge end.

The cutting-gas passage 2 is surrounded, over the entire axial length of the nozzle 1 by an annular oxygen-curtain passage 3 such that the wall thickness a between the central passage 2 and the annular passage 3 at the end of the nozzle is at most 0.5 mm. The width b of the gas-curtain passage 3 at its discharge end is not greater than 0.3 mm.

In the embodiment shown in FIGS. 1 and 2 oxygen supplied at line 14 from the usual pressure-control tank or bottle, can be split through independently controlled valves 12 and 13 and delivered via lines 10 and 11 to the passages 2 and 3. This permits independent control of the flow of oxygen through the central passage and the oxygen-curtain passage in the indicated proportions. The heating gas can be acetylene which can be supplied via a valve 16 and a line 15 to an array of axially extending angularly spaced bores 4 which also open at the outlet end of the nozzle.

Figure 3:
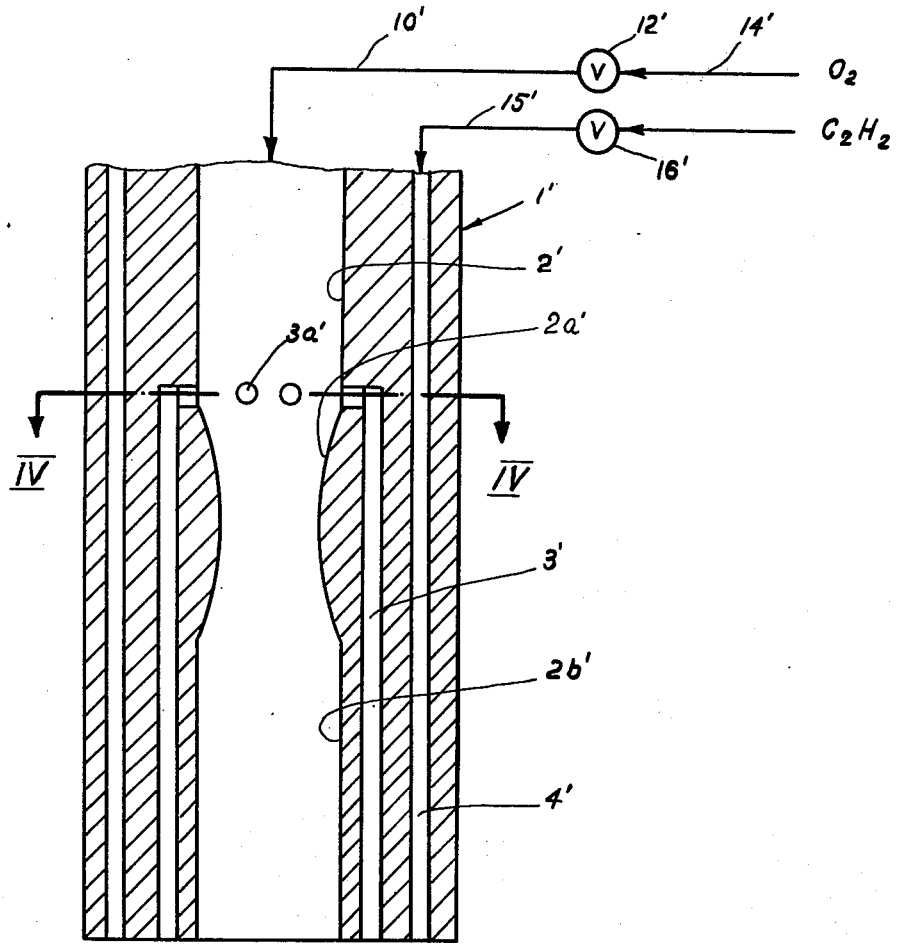
FIG. 3 is a cross-sectional view similar to FIG. 1 but illustrating another embodiment of the invention.
Figure 4:
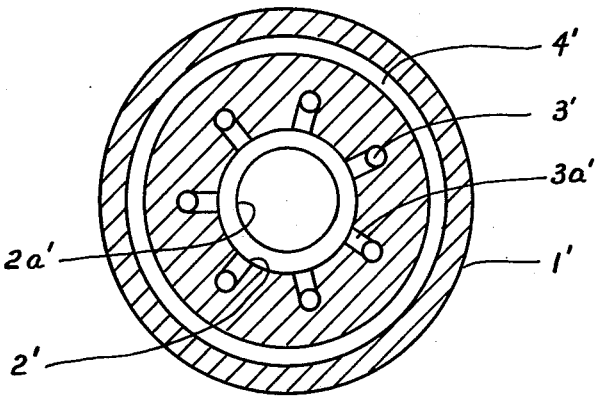
FIG. 4 is a cross-sectional view taken along the line IV—IV of FIG. 3.

FIGS. 3 and 4 illustrate another embodiment of the invention in which the nozzle 1' has a central passage 2' which can be formed with a constriction 2*a*' at a location upstream from the end of the nozzle but otherwise has a cylindrical configuration as represented at 2*b*'. In this embodiment, the oxygen-curtain passage means is an array of axially-extending bores 3' which communicate with the passage 2' via fine holes 3*a*' so that the proportion of oxygen delivered to the passages 3' is determined by the cross section of the bores 3*a*'. In this embodiment, moreover, the heating gas passage 4' is annular and coaxially surrounds the passage 2'.

Oxygen is delivered by line 14' through a valve 12' and a line 10' to the passage 2' from which it enters via bores 3*a*' the gas-curtain passage means 3'. Acetylene is supplied via valve 16' at line 15' to the annular passage 4'.

Naturally, features of one embodiment may be used in other and vice versa. For example, the array of bores 3' may be replaced by the annular passage 3 of the embodiment of FIGS. 1 and 2, this annular passage communicating via holes 3*a*' with the central passage 2'.

Alternatively or in addition, the generally cylindrical central passage 2' may be formed as a LAVAL nozzle or merely with an outwardly widening end as has been shown in FIG. 1 for the passage 2.

Alternatively or in addition, the annular passage 4' may be formed as an array of bores as has been illustrated for the passages 4 in FIGS. 1 and 2.

The advantage of an arrangement in which the gas-curtain passage 3 or 3' communicates with the central passage 2 or 2' via an array of holes or orifices (as illustrated at 3*a'*) is that with an increase in the forepressure of the cutting oxygen, for increased cutting speed, there is a corresponding increase in the rate of flow of oxygen in the gas-curtain passage means, while maintaining the aforedescribed proportions, and thereby maintaining the quality of the cut.

I claim:

1. In a method of operating a cutting burner for the autogenous cutting of a metal workpiece, said cutting burner having a nozzle directing an oxygen cutting jet against said workpiece and forming an oxygen curtain around said cutting jet, said cutting jet being formed by passing cutting oxygen through a cutting-jet passage and said curtain being formed by passing oxygen through a passage means, the improvement which comprises proportioning the oxygen flow rates through said cutting-jet passage and said passage means such that the oxygen flow rate through said passage means is 5 to 25% of the oxygen flow rate through said cutting-jet passage, and directing a heating gas against said burner piece from said nozzle by passing said heating gas through said nozzle outwardly of said passage means.

2. The improvement defined in claim 1 wherein the oxygen flow rate through said passage means is 5 to 15% of the oxygen flow rate through said cutting-jet passage.

3. The improvement defined in claim 2 wherein the oxygen forming said curtain is discharged from said nozzle through an annular opening spaced at most by 0.5 mm from said cutting-jet passage and having a radial width of at most 0.3 mm.

4. A nozzle for metal-cutting torch comprising an elongated nozzle body formed with a central nozzle passage connected to a source of oxygen cutting gas and opening at an end of said body, passage means radially outwardly of said passage for delivering oxygen-curtain gas in a sheath around an oxygen cutting jet emerging from said central passage, and at least one heating gas passage disposed outwardly of said passage means for delivering a heating gas to said, said pasage means at said end being spaced by at most 0.5 mm from said central passage, said passage means being an annular passage surrounding said central passage and opening at said end with a radial width of at most 0.3 mm, said central passage being formed with a converging-/diverging LAVAL nozzle.

5. The nozzle defined in claim 4, further comprising a plurality of bores connecting said passage means with said central passage for proportioning the oxygen flow rates between said central passage and said passage means whereby the flow rates are determined by adjusting the pressure of the oxygen fed to the nozzle.

6. The nozzle defined in claim 4 wherein said central passage has a conical divergence at said end.

* * * * *